US007144339B1

(12) United States Patent
Towsen

(10) Patent No.: US 7,144,339 B1
(45) Date of Patent: Dec. 5, 2006

(54) GOLF SWING PRACTICE AND TRAINING TOWEL

(75) Inventor: Brian Lawrance Towsen, George (ZA)

(73) Assignee: Werner Gerrit Roux, Geoge (ZA)

( * ) Notice: Subject to any disclaimer, the term of this patent is extended or adjusted under 35 U.S.C. 154(b) by 25 days.

(21) Appl. No.: 11/120,778

(22) Filed: May 2, 2005

Related U.S. Application Data

(62) Division of application No. 10/672,557, filed on Sep. 26, 2003, now abandoned.

(51) Int. Cl.
*A63B 69/36* (2006.01)

(52) U.S. Cl. ..... 473/409; 473/270

(58) Field of Classification Search ..... 473/270, 473/266, 278, 409
See application file for complete search history.

(56) References Cited

U.S. PATENT DOCUMENTS

| | | | | |
|---|---|---|---|---|
| 3,350,101 | A * | 10/1967 | Bishop et al. | 473/265 |
| 3,542,369 | A | 11/1970 | Anderson | |
| 4,023,810 | A | 5/1977 | Lorang | |
| 4,248,431 | A | 2/1981 | Burnes | |
| 4,355,810 | A | 10/1982 | Rydeck | |
| 4,805,913 | A | 2/1989 | Bott | |
| 4,915,387 | A | 4/1990 | Baxstrom | |
| D308,087 | S * | 5/1990 | Buffey | D21/792 |
| 5,035,433 | A | 7/1991 | Durso | |
| 5,071,130 | A | 12/1991 | Shofner | |
| 5,163,686 | A | 11/1992 | Bergman | |
| 5,306,011 | A | 4/1994 | Perry | |
| 5,330,176 | A | 7/1994 | Cagney, Jr. | |
| 5,478,082 | A | 12/1995 | De Knight et al. | |
| 5,645,494 | A | 7/1997 | Dionne et al. | |
| 6,050,902 | A * | 4/2000 | McCrink, Jr. | 473/168 |
| 6,387,013 | B1 | 5/2002 | Marquez | |
| 6,482,102 | B1 | 11/2002 | Grabowski | |
| 6,500,075 | B1 | 12/2002 | McDevitt | |
| 6,592,376 | B1 | 7/2003 | Carpenter | |
| 2002/0169029 | A1 | 11/2002 | Bradbury | |

FOREIGN PATENT DOCUMENTS

| | | |
|---|---|---|
| GB | 2.196.859 | 5/1988 |
| GB | 2.262.453 | 6/1993 |
| WO | WO01/60466 | 8/2001 |

* cited by examiner

*Primary Examiner*—Raleigh W. Chiu
(74) *Attorney, Agent, or Firm*—Berenato, White & Stavish

(57) ABSTRACT

A golf swing practice and training towel comprising a cloth golf towel having a plurality of longitudinal and transverse lines forming a grid with indicia identifying each line. The towel is placed on the ground with one edge in linear alignment with the target towards which the ball is to be hit and the golfer uses the lines as reference points regarding ball placement, stance, hand position, club face alignment and the like to incrementally adjust and consistently repeat such critical aspects of a golf swing.

3 Claims, 17 Drawing Sheets

(FUNCTION ONE)

(FUNCTION TWO)

(FUNCTION THREE)

(FUNCTION FOUR)

(FUNCTION FIVE)

(FUNCTION SIX)

(FUNCTION SEVEN)

(FUNCTION EIGHT-PART ONE)

(FUNCTION EIGHT-PART TWO)

(FUNCTION EIGHT-PART THREE)

(FUNCTION NINE-PART ONE)

(FUNCTION NINE-PART TWO)

(FUNCTION NINE-PART THREE)

(FUNCTION TEN)

GOLF SWING PRACTICE AND TRAINING TOWEL

This application is a division of application Ser. No. 10,672,557 filed on Sep. 26, 2003 now abandoned.

BACKGROUND OF THE INVENTION

1. Field of the Invention

The present invention relates generally to golf training devices and, more specifically, to a golf swing practice and training towel comprising a golf towel having a plurality of spaced apart lines extending longitudinally and transversely thereacross that are visible when the towel is placed on the ground to afford the user a plurality of alignment positions for foot, hand, ball and club head placement relative to the target and the desired trajectory thereof. The transverse lines serve as reference points for how far the golfer's feet are separated during the swing thus allowing for incremental adjustments to find the optimum positioning for balance and transferring the weight from one leg to another and subsequently performing precise repetitions of the swing from that specific stance.

2. Description of the Prior Art

While there are other golf practice devices, they are not as suitable as the present invention. The present invention serves to provide a simple effective practice and training towel for a golfer to develop consistency in their stance and swing. The present invention serves to function as an ordinary golf towel when not in use as a training and practice aid thereby eliminating clutter in the golf bag by not adding an additional accessory.

SUMMARY OF THE PRESENT INVENTION

A primary object of the present invention is to provide a golf swing practice and training towel comprising a golf towel with grid-like indicia that is placed on the ground to act as an alignment tool for practicing a consistent golf swing.

Another object of the present invention is to provide a golf swing practice and training towel that serves as a reference for developing a proper stance to optimize balance when transferring weight from one leg to the other during the swing.

Yet another object of the present invention is to provide a golf swing practice and training towel that will enable a golfer to establish a target line that is parallel to the tips of the user's shoes.

Still yet another object of the present invention is to provide a golf swing practice and training towel that will assist the user in setting up a stance relative to the position of the ball.

Another object of the present invention is to provide a golf swing practice and training towel that will assist in proper club face alignment relative to the golfer, the ball and the target.

Yet another object of the present invention is to provide a golf swing practice and training towel that can provide a reference of the distance that the golfer is setting up away from the ball.

Still yet another object of the present invention is to provide a golf swing practice and training towel that is simple and easy to use.

Another object of the present invention is to provide a golf swing practice and training towel that is inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
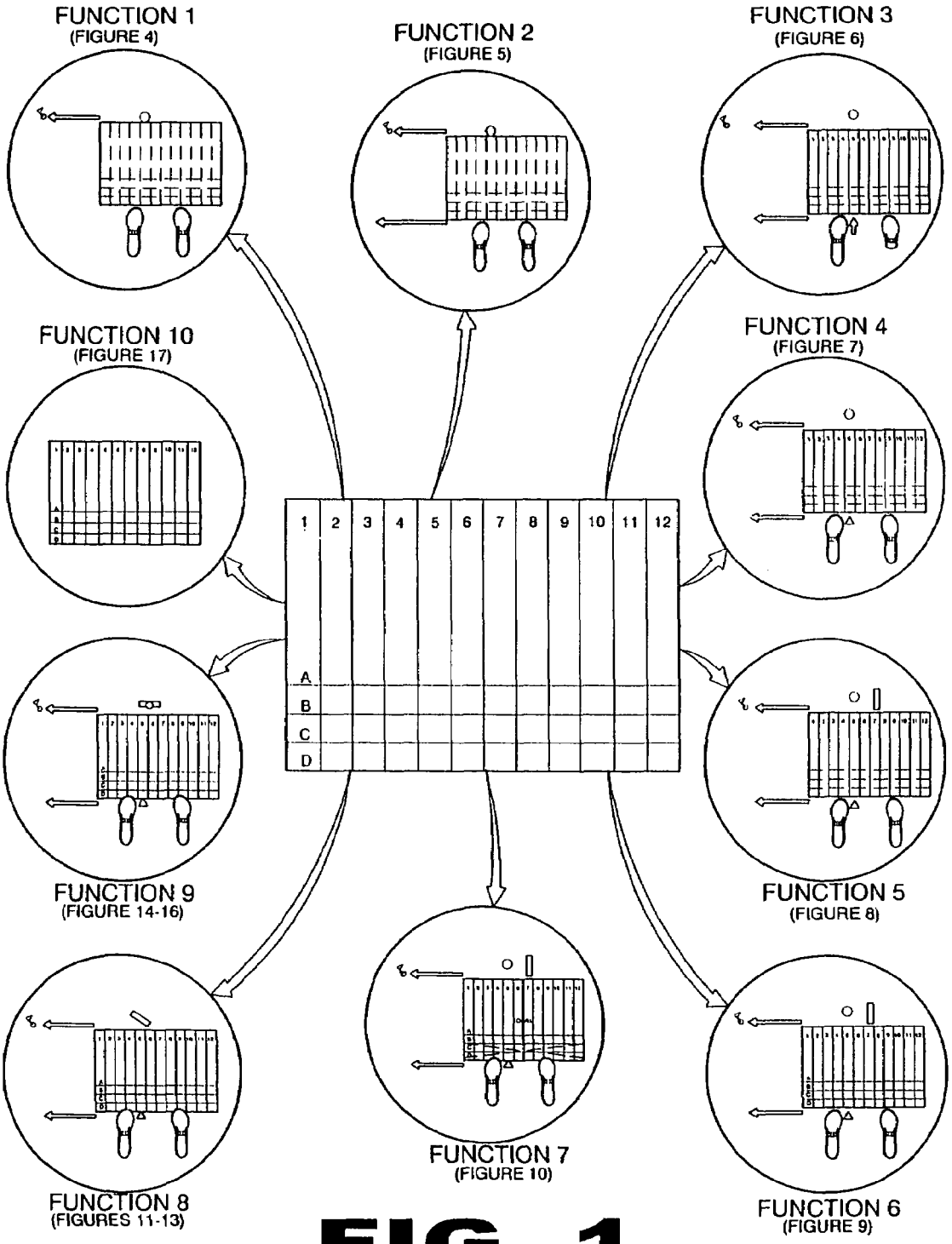
FIG. 1 is an illustrative view of the uses of the present invention.

Turning now descriptively to the drawings, in which similar reference characters denote similar elements throughout the several views, the figures illustrate the Golf Swing Practice and Training Towel of the present invention.

With regard to the reference numerals used, the following numbering is used throughout the various drawing figures.

10 Golf Swing Practice and Training Towel
12 flexible sheet
14 target
16 golfer
18 body line
20 target line
24 longitudinal lines
26 transverse lines
28 indicia
30 numeric indicia
32 alphabetic indicia
33 foot position
34 ball position
36 club head
38 hand position
40 grid
42 closed stance line
44 open stance line
46 divot

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the uses of the present invention. The present invention is a multi-function rectangular towel having one set of spaced apart parallel lines longitudinally extending along one side with spaced apart parallel lines extending latitudinally between the other two sides thereby providing means to assist a golfer in various critical aspects of the game. The towel provides means to establish an intended trajectory line between a starting point, such as a tee, and intended ball location, such as a greens' flag; along with club alignment relative to the line of sight trajectory, ball position, hand position, distance the user stands from the ball and divot analysis. The towel also serves as a golf towel that one would use during normal play.

Figure 2:
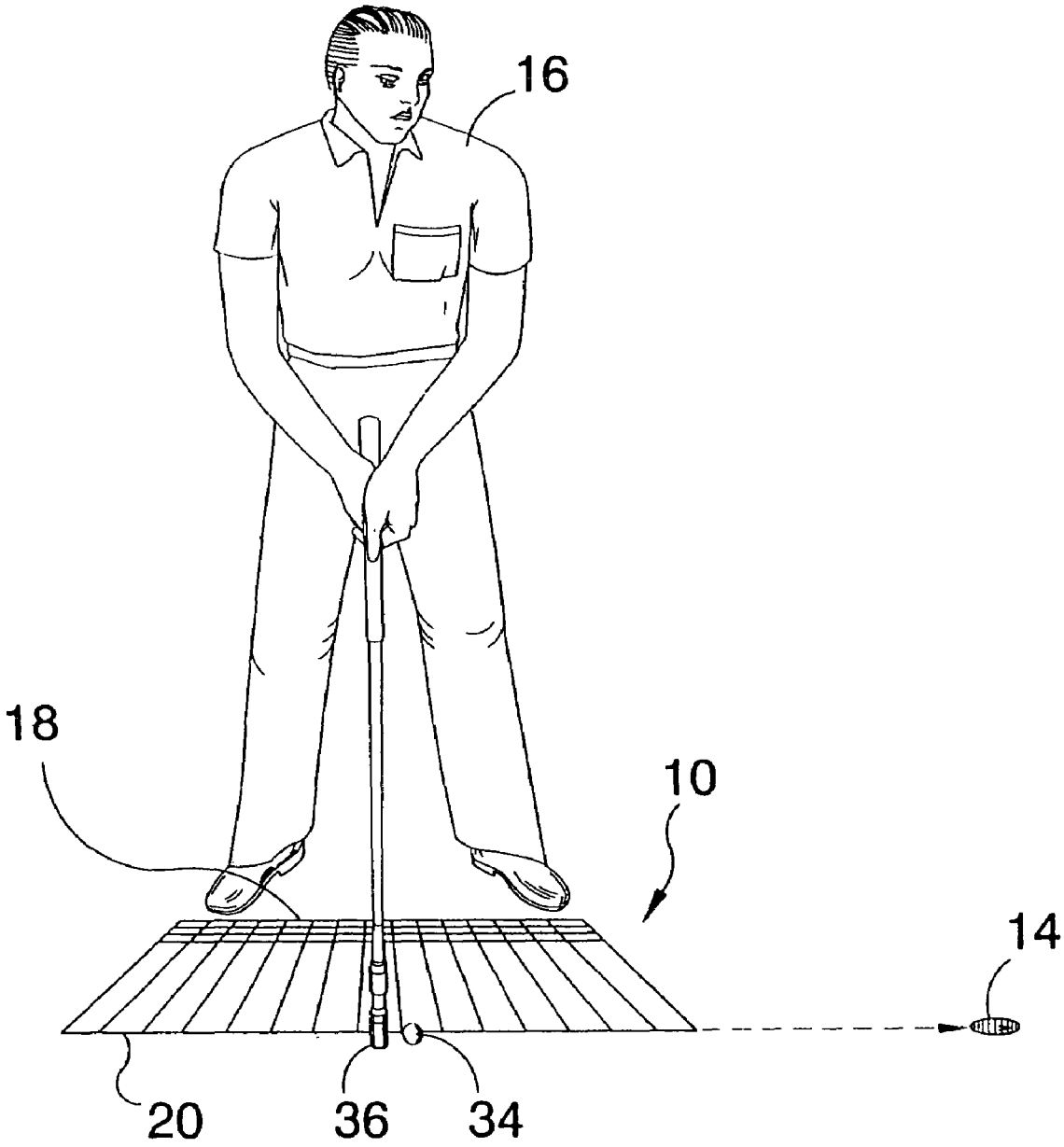
FIG. 2 is an illustrative view of the present invention in use.

FIG. 2 is an illustrative view of the present invention 10 in use. Depicted is the present invention 10 in use illustrating the myriad variables that determine the location of the ball 34. After club selection, how a golfer 16 addresses the ball 34 determines the location of the ball 34. Addressing the ball 34 includes using the target line 20 to draw an imaginary line to the target 14 location parallel to the tips of the shoes placed proximal to the body line 18 in conjunction with coplanar club head 36 placement in the vertical and horizontal with corresponding hand placement, along with distance from the ball 34. Currently a golfer 16 tries to mimic variables resulting in favorable ball 34 play while changing one or more during unfavorable ball 34 play. It is virtually impossible to mimic such diverse intertwined fluctuating functions. The present invention 10 provides means whereby multiple references can be established duly noting other mutable variables enabling a golfer to reposition their stance consistently thereby providing knowledgeable cause and effect judgment of changes to the established variables.

Figure 3:
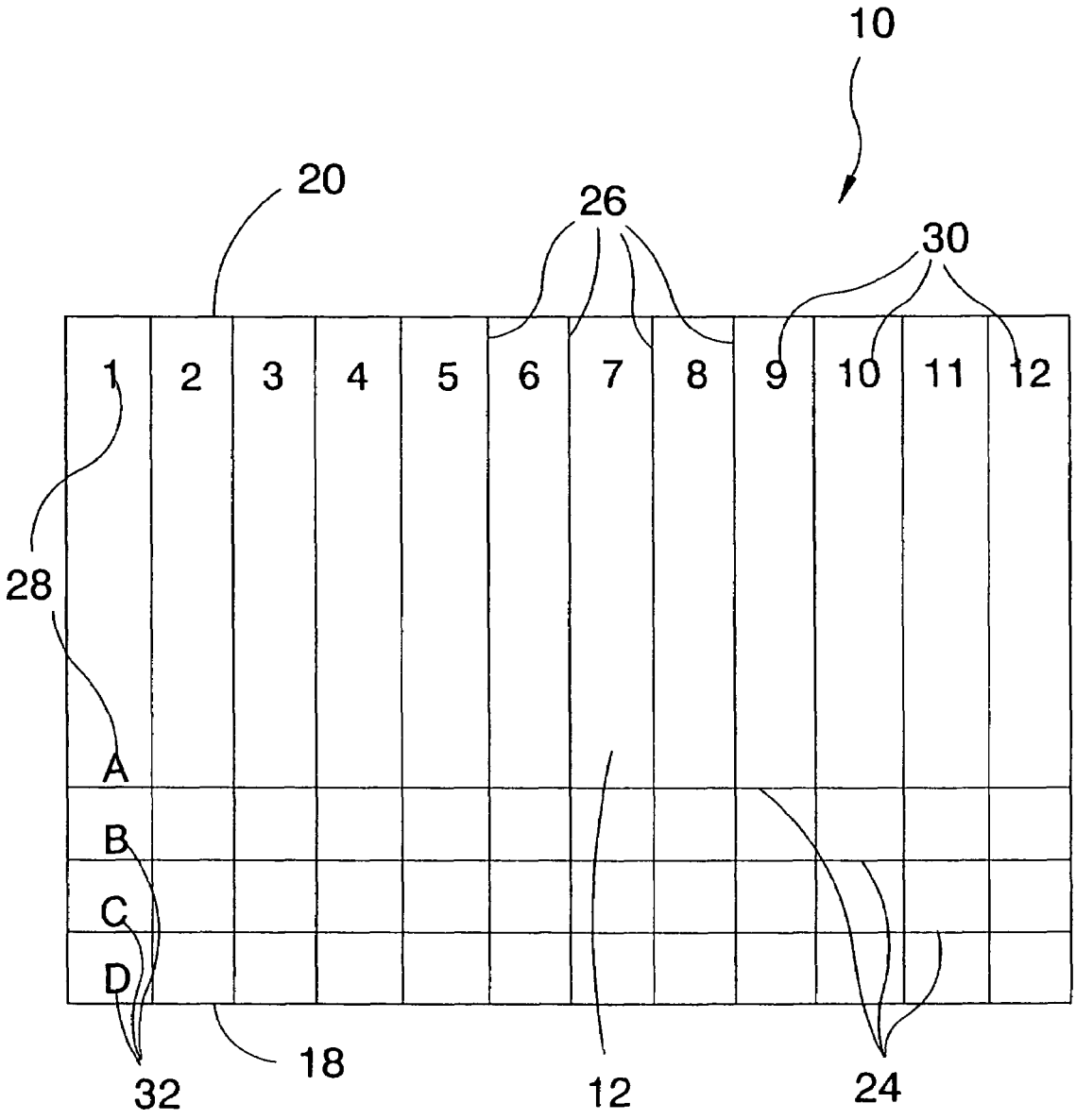
FIG. 3 is a top view of the present invention.

FIG. 3 is a top view of the present invention 10. Shown is the golf practice and training towel of the present invention 10 comprising a flexible sheet 12 with spaced apart longitudinal and transverse parallel lines 24,26. Each transverse line 26 has numeric indicia 30 that assist the golfer with ball position, hand position, divot analysis and club head alignment and foot location. The longitudinal lines 24 also have indicia 28, such as alphabetic indicia 32 to differentiate from the transverse line 26 numeric indicia 30, on which the sheet 12 can be folded to change the distance between the golfer and the golf ball.

Figure 4:
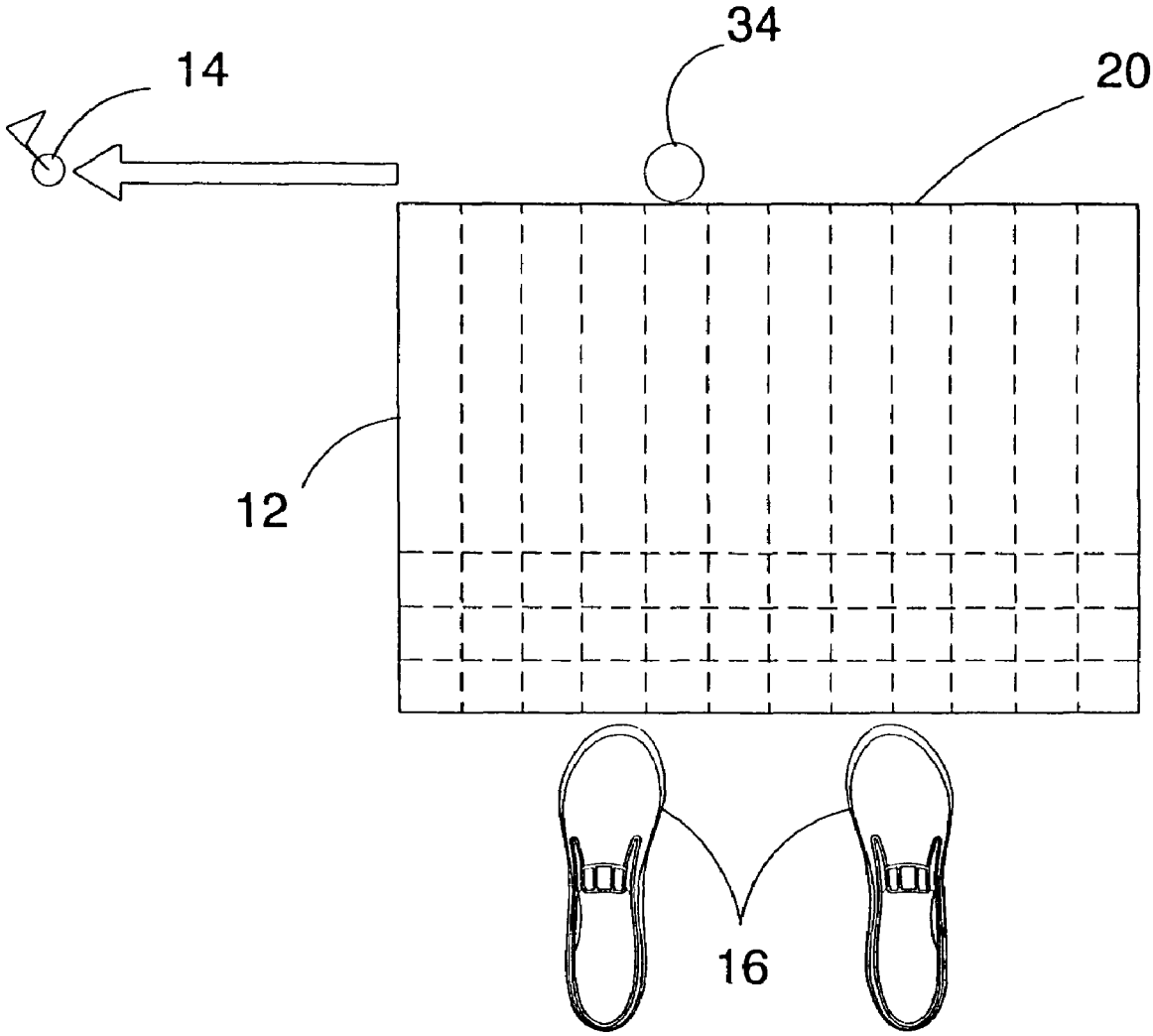
FIG. 4 is a top view demonstrating function one of the present invention.

FIG. 4 is a top view demonstrating function one of the present invention 10. To more clearly explain the functions of the present invention 10, the following illustrations will be referred to as functions 1 through 10. Function number one shows the target line 20 at the edge of the sheet 12 away from the golfer 16. The target line 20 is aligned to the target 14. This provides the golfer 16 with a straight line from their present position to the target 14. The golfer 16 uses this line to align the ball to the target 14. The golfer 16 can be left or right handed.

Figure 5:
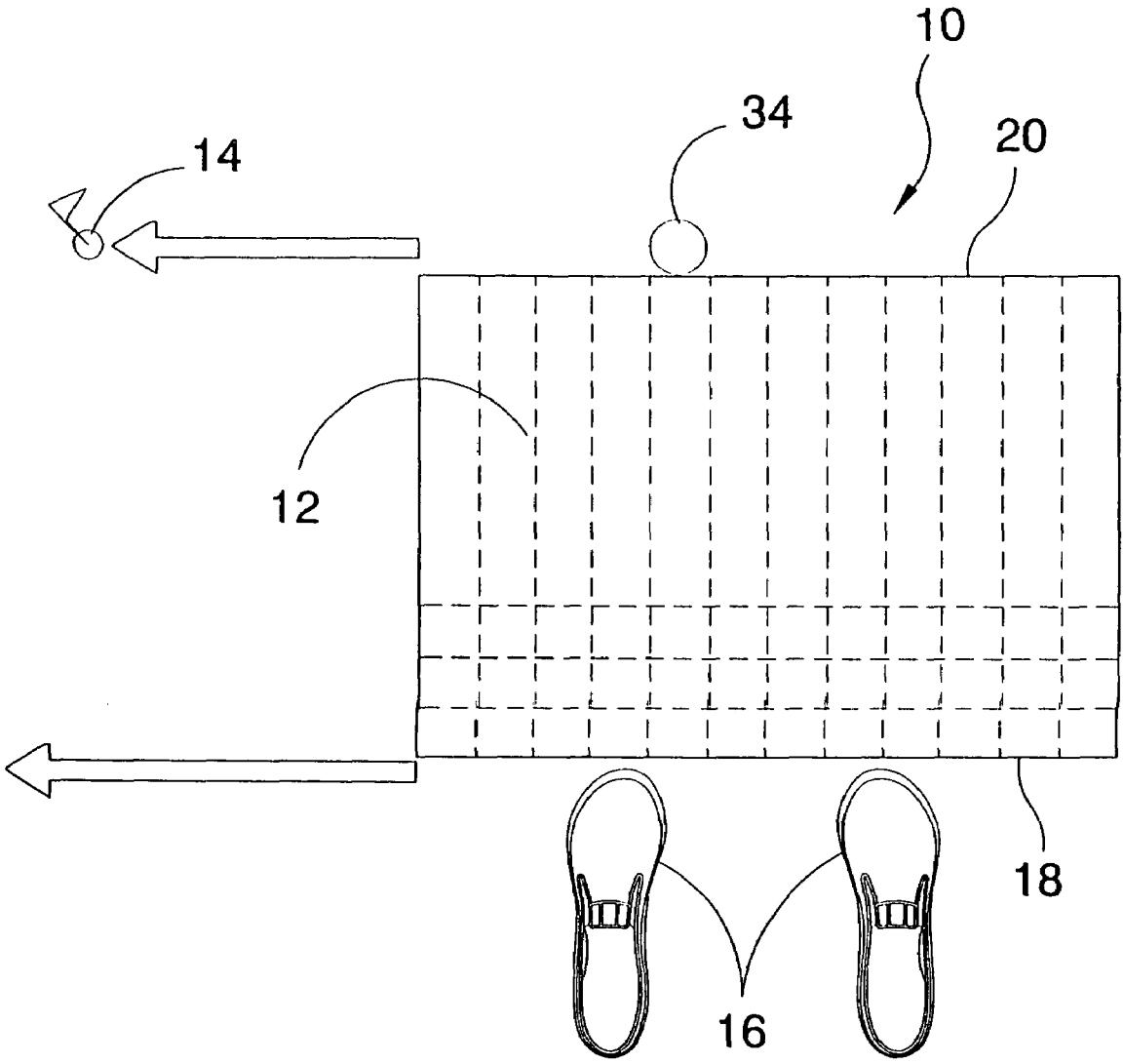
FIG. 5 is a top view demonstrating function two of the present invention.

FIG. 5 is a top view demonstrating function two of the present invention 10. In function number two, the body line 18 is indicated by the near edge of the sheet 12. The body line 18 is automatically aligned parallel to the intended target 14 thus providing the golfer 16 with a straight parallel line from their present position parallel to the target 14. The golfer 16 uses the body line 18 to align their feet, knees, hips and shoulders parallel to the target line 20. The golfer 16 can be left or right handed. The purpose of functions 1 and 2 is that the target line 20 and body line 18 are used by the golfer 16 to make a perfect aligned stance to the target 14. The golfer 16 is aligning the ball 34 along the target line 20, with their body along the body line 18 therefore aiming straight at the target 14.

Figure 6:
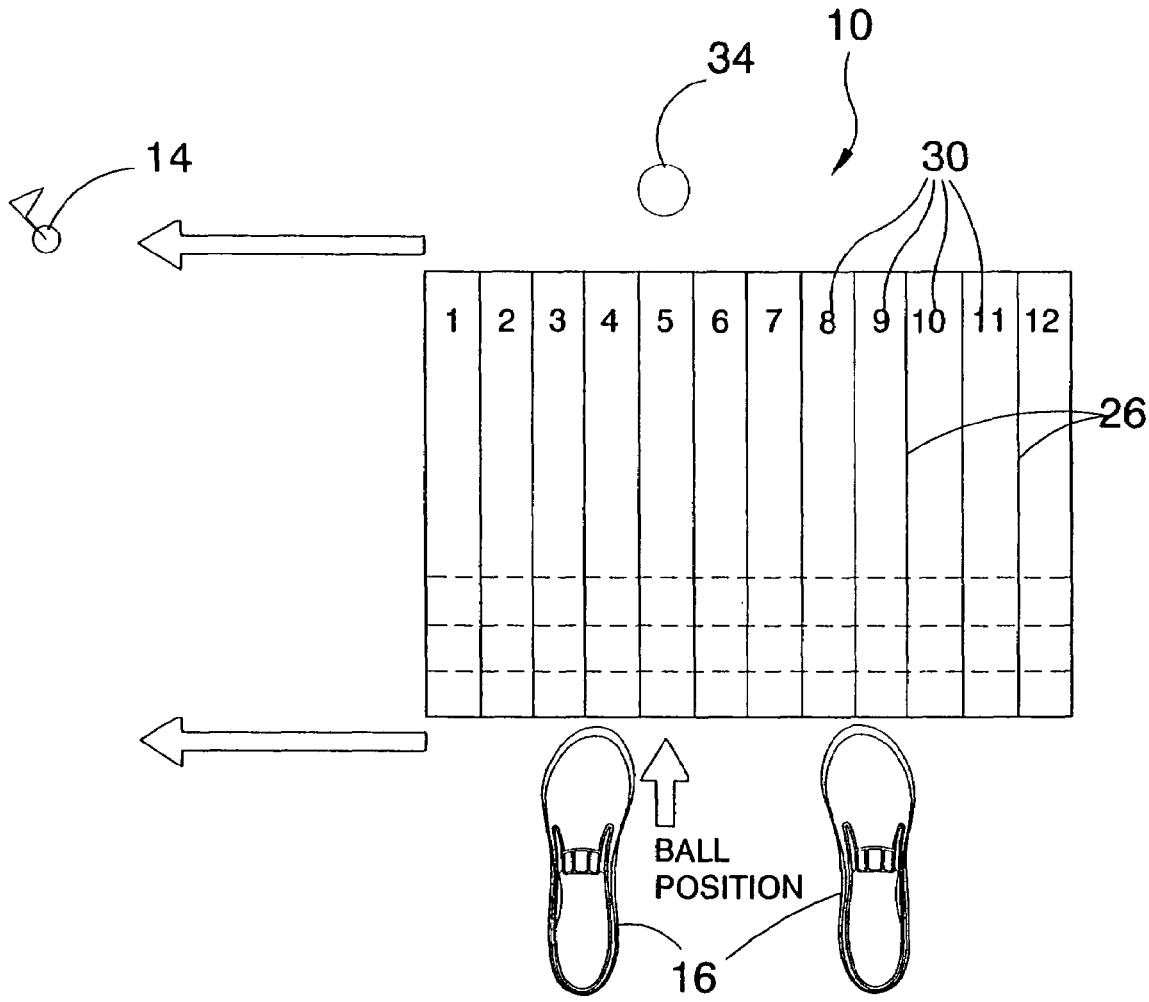
FIG. 6 is a top view demonstrating function three of the present invention.

FIG. 6 is a top view demonstrating function three of the present invention wherein transverse lines 26 with corresponding numerical indicia 30 numbered 1 through 12 are used by the golfer 16 as a reference from where to place the ball 34 in their stance. The transverse lines 26 will indicate if they are playing the ball 34 in the front, middle or back of their stance relative to their feet. The purpose of this function is that the golfer 16 can play the ball 34 from different positions in their stance and use the relevant feedback from the ball's flight to decide optimum ball placement relative to their stance.

Figure 7:
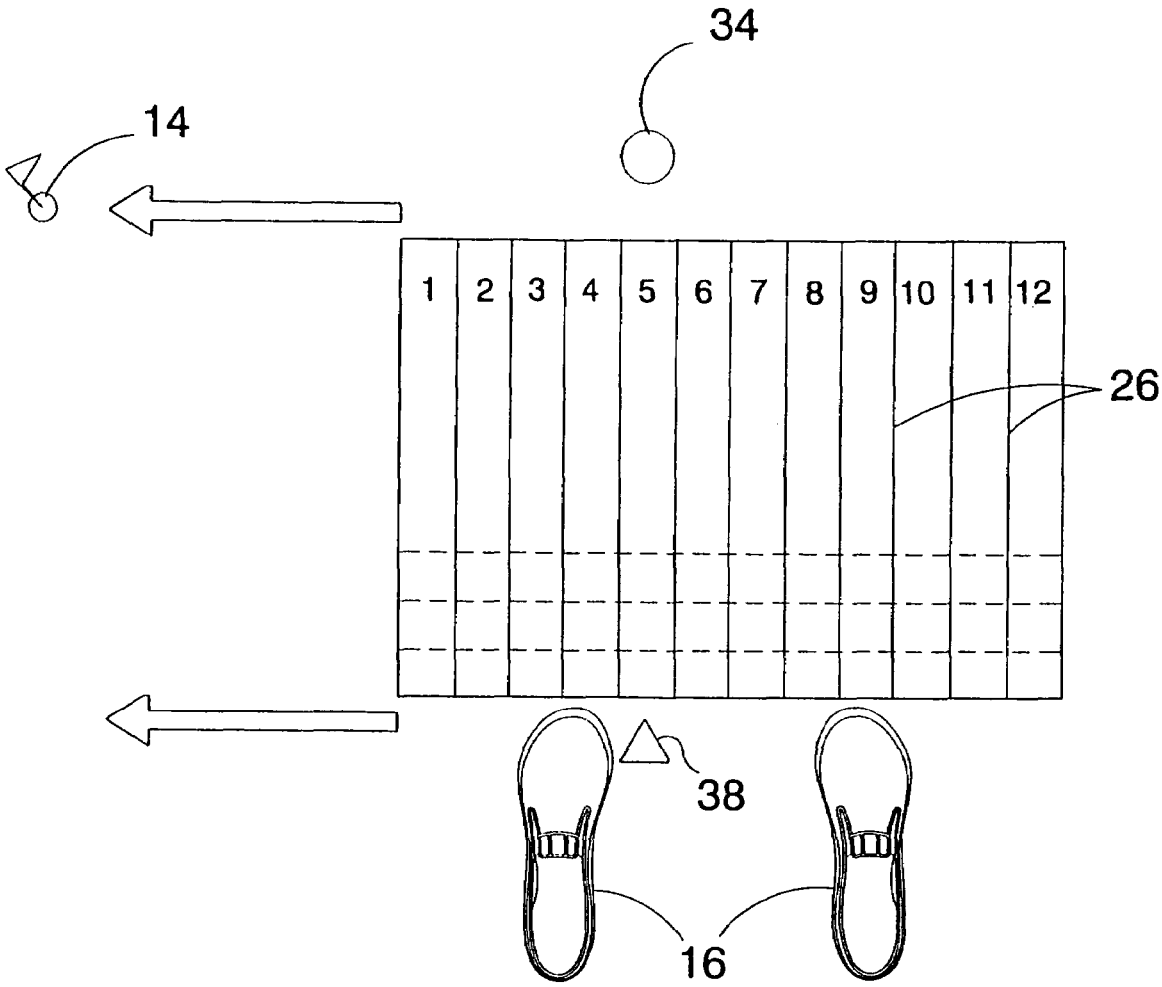
FIG. 7 is a top view demonstrating function four of the present invention.

FIG. 7 is a top view demonstrating function four wherein the transverse lines 26 have corresponding indicia numbered 1 through 12 that are used by the golfer 16 as a reference as to the hand position 38 when addressing the ball 34. The transverse lines 26 will indicate if they are addressing the ball 34 with their hands in front of the ball 34 or on the ball 34 or the back of the ball 34. The purpose of this function is the golfer 16 can play the ball 34 with their hands in different positions and use the relevant feedback from the ball's 34 flight to decide optimum hand placement.

Figure 8:
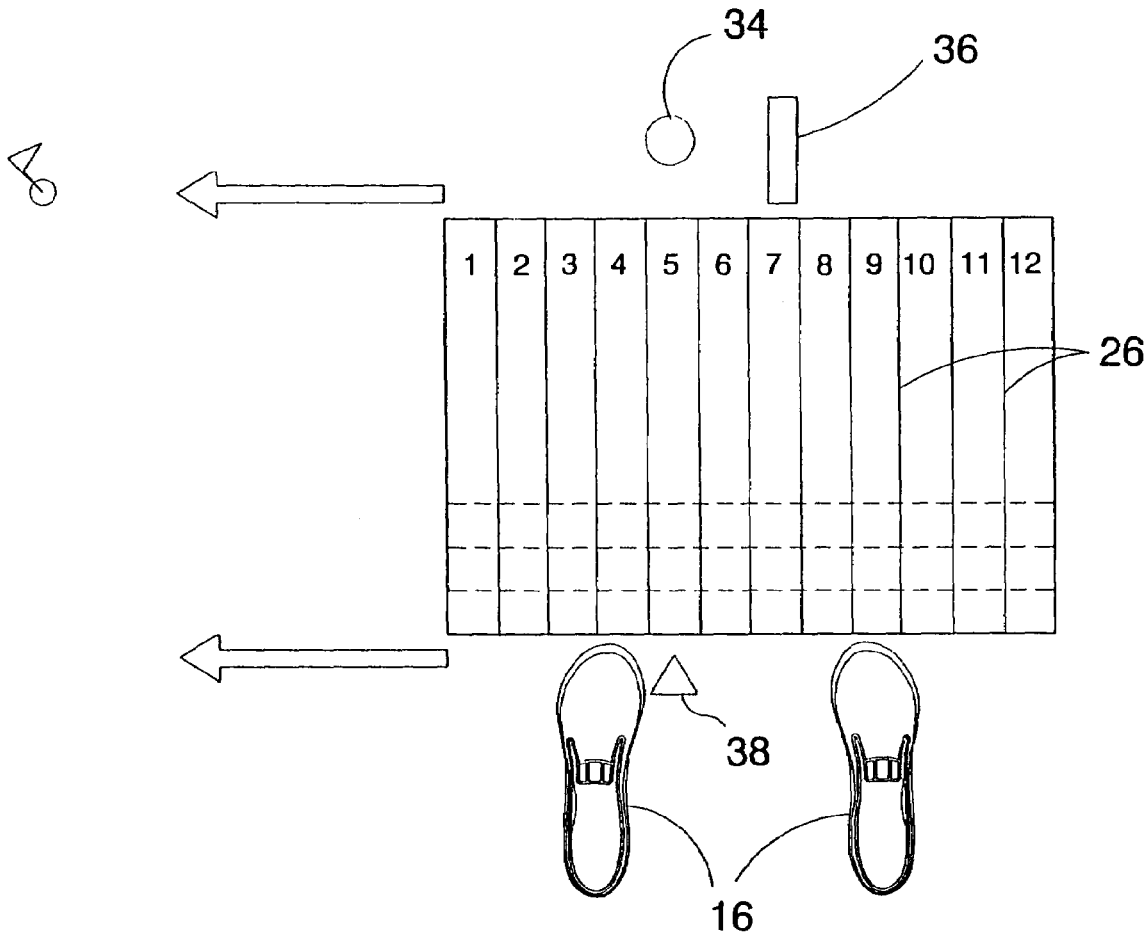
FIG. 8 is a top view demonstrating function five of the present invention.

FIG. 8 is a top view demonstrating function five of the present invention 10 wherein by using the transverse lines 26 as a reference, the golfer 16 can easily see if the clubface is open or closed on address. The purpose of this function is that the golfer 16 can play the ball 34 with an open or closed clubface and use the relevant feedback from the ball's 34 flight to decide if they prefer hitting the ball 34 with an open or closed clubface.

Figure 9:
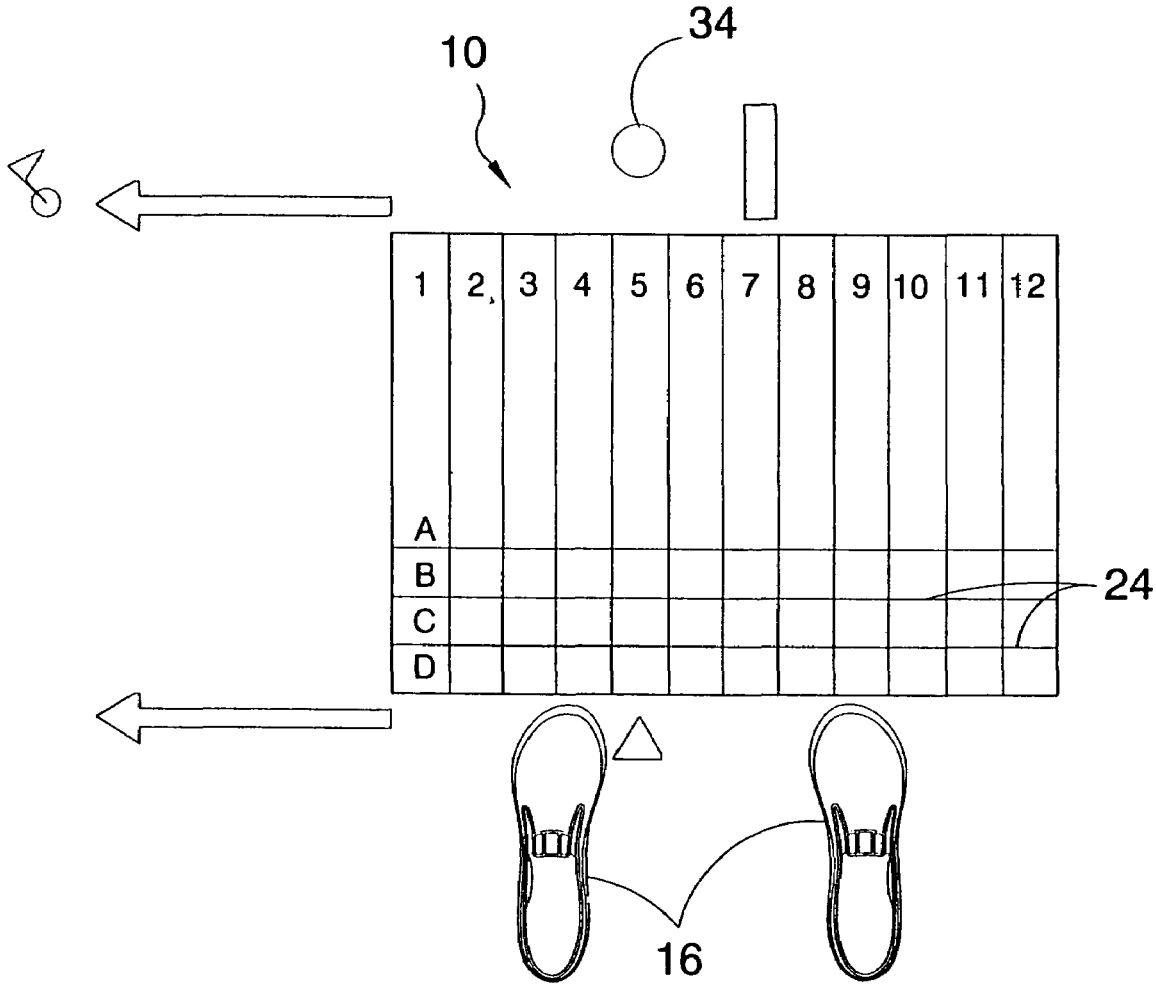
FIG. 9 is a top view demonstrating function six of the present invention.

FIG. 9 is a top view of function six of the present invention 10 wherein the sheet 12 can be folded at one of longitudinal lines a, b, c, d to accommodate longer and shorter club selection and distance that the golfer 16 stands away from the ball 34. The purpose of this function allows the golfer 16 to fold the sheet 12 to play the ball 34 with their stance closer to or further from the ball 34 and use the relevant feedback from the ball's 34 flight to decide how far they prefer to stand from the ball 34 at address.

Figure 10:
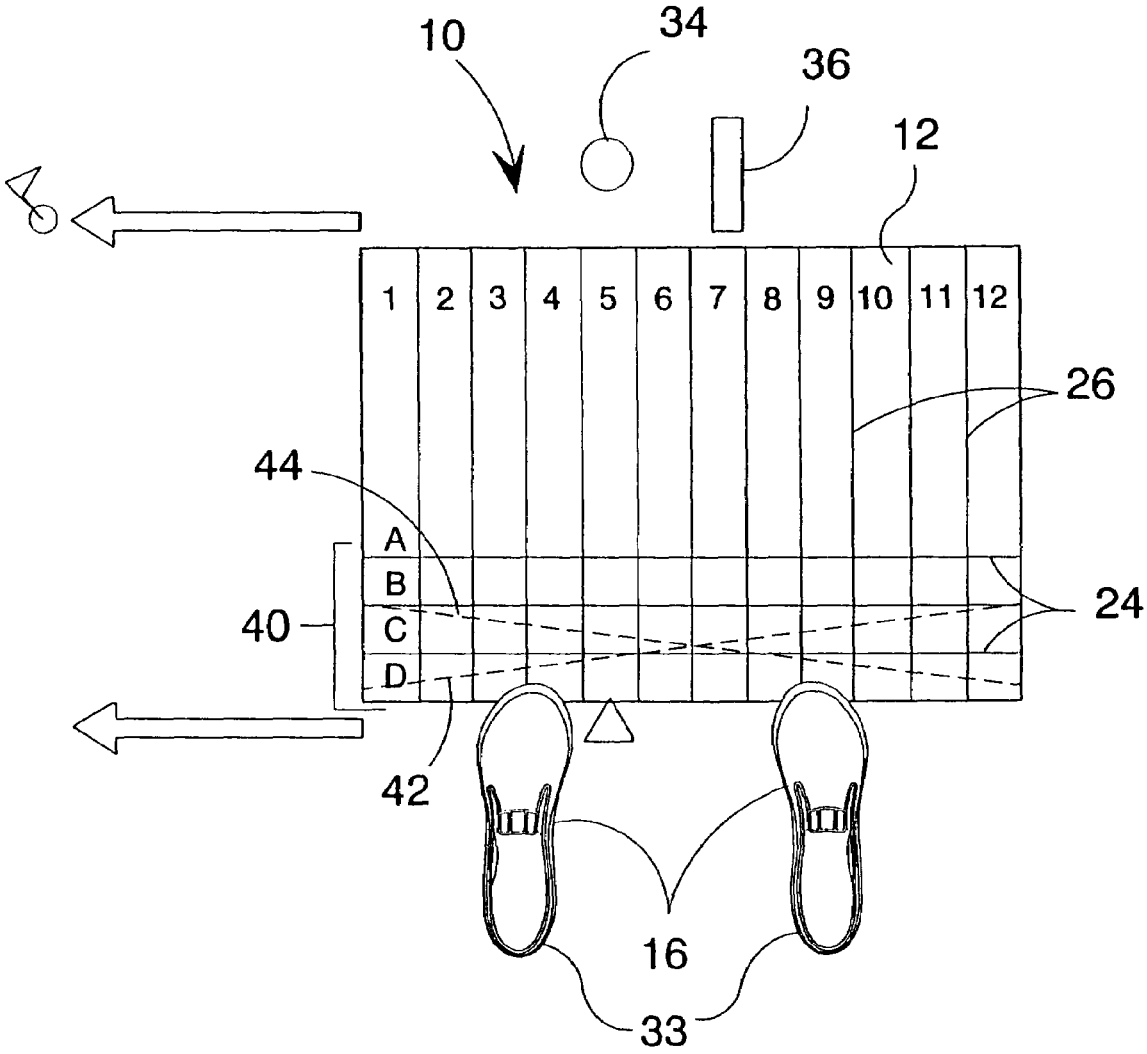
FIG. 10 is a top view demonstrating function seven of the present invention.

FIG. 10 is a top view demonstrating function seven of the present invention 10 wherein the longitudinal lines a, b, c, d and the transverse lines 26 form a grid 40 that enable the sheet 12 to be folded at different angles. For example, the golfer 16 can fold the sheet 12 from a1 to b2. This will give the golfer 16 a defined closed stance line 42 to demonstrate the proper foot position 33 for a slightly closed stance. Folding the sheet 12 from a2 to b1 will give the golfer 16 a defined open stance line 44 to achieve a slightly open stance. The purpose of this function is to enable the golfer 16 to fold the sheet 12 to play the ball 34 with their stance slightly open or closed and use the relevant feedback from the balls 34 flight to decide if they prefer to play the ball 34 with their stance slightly open, closed or square.

Figure 11:
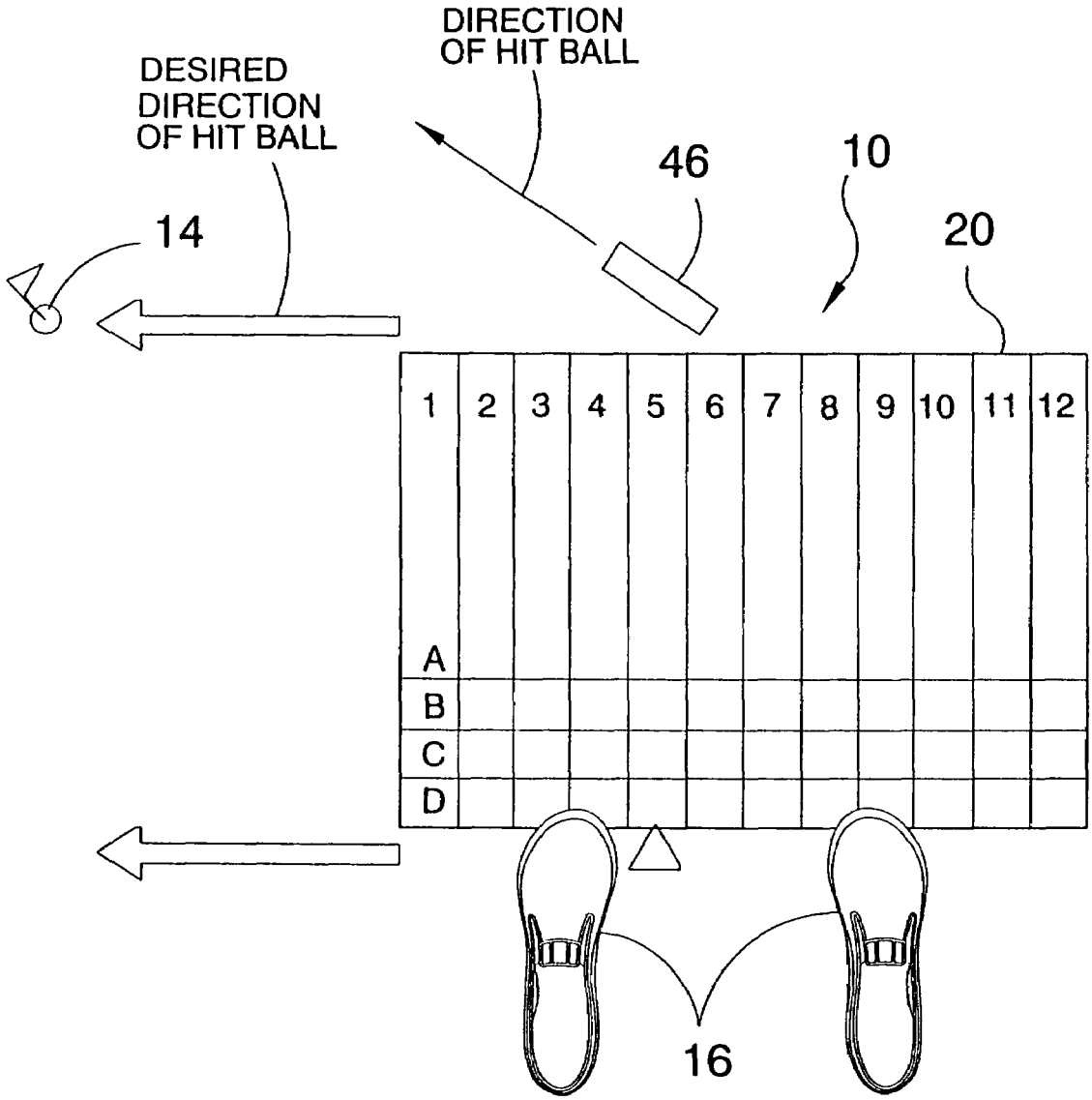
FIG. 11 is a top view demonstrating the first part of function eight of the present invention.

FIG. 11 is a top view demonstrating the first part of function eight of the present invention 10. Function number eight is a three-part function providing divot analysis wherein the present invention 10 denotes the target line being parallel with the desired direction of the ball when hit. The ensuing divot 46 should be parallel with the target line 20. The first part indicates an inside to outside swing to the right of the target 14. The purpose of this function is that the golfer 16 can use this information to get the desirable downswing of the club during the hitting of a golf ball 34.

Figure 12:
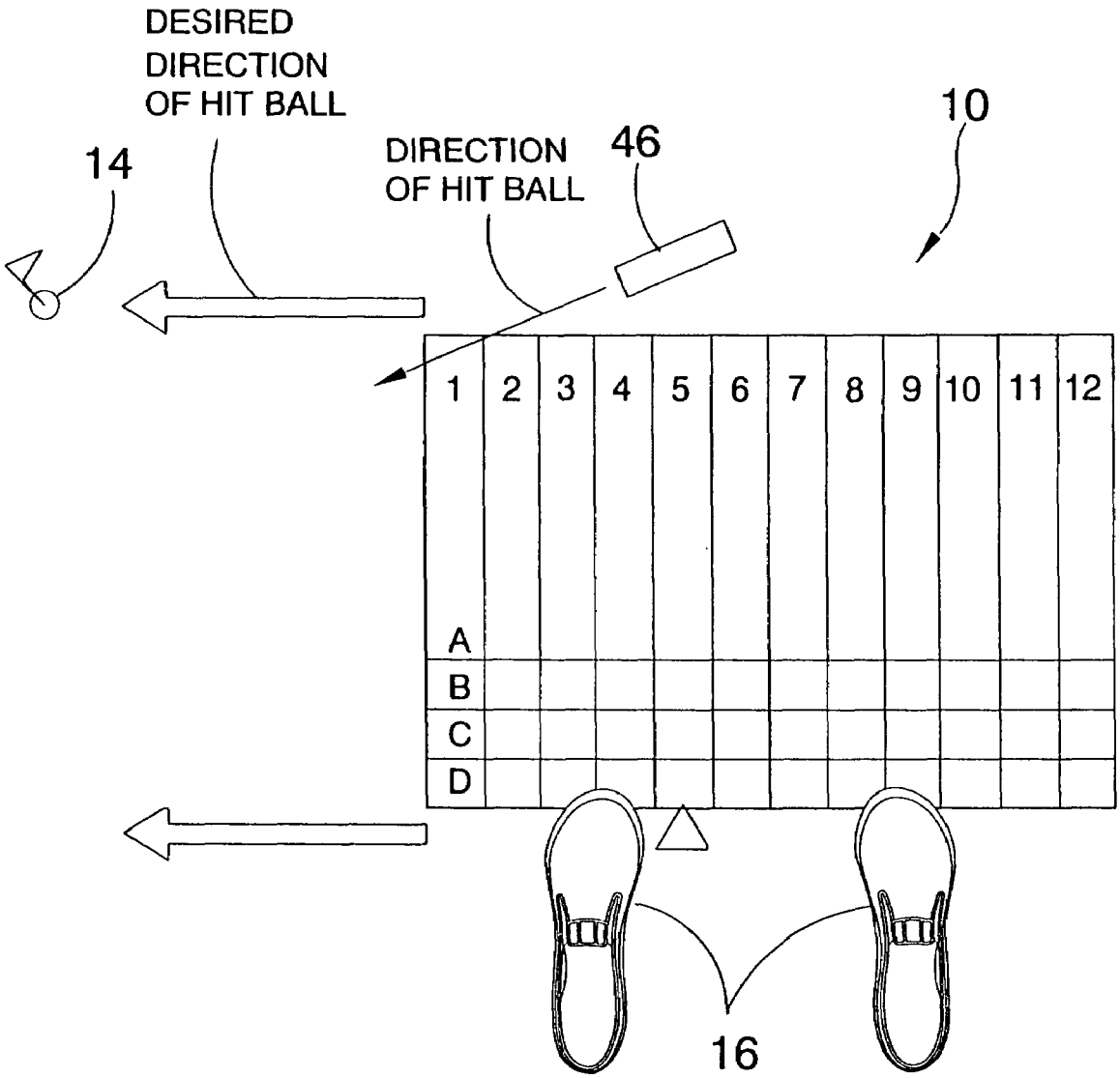
FIG. 12 is a top view demonstrating the second part of function eight of the present invention.

FIG. 12 is a top view of the second part of function eight of the present invention 10 providing divot analysis. The angle of the resultant divot 46 indicates an outside to inside swing to the left of the target 14. The purpose of this function is that the golfer 16 can use this information to get the desirable downswing of the club during the hitting of a golf ball.

Figure 13:
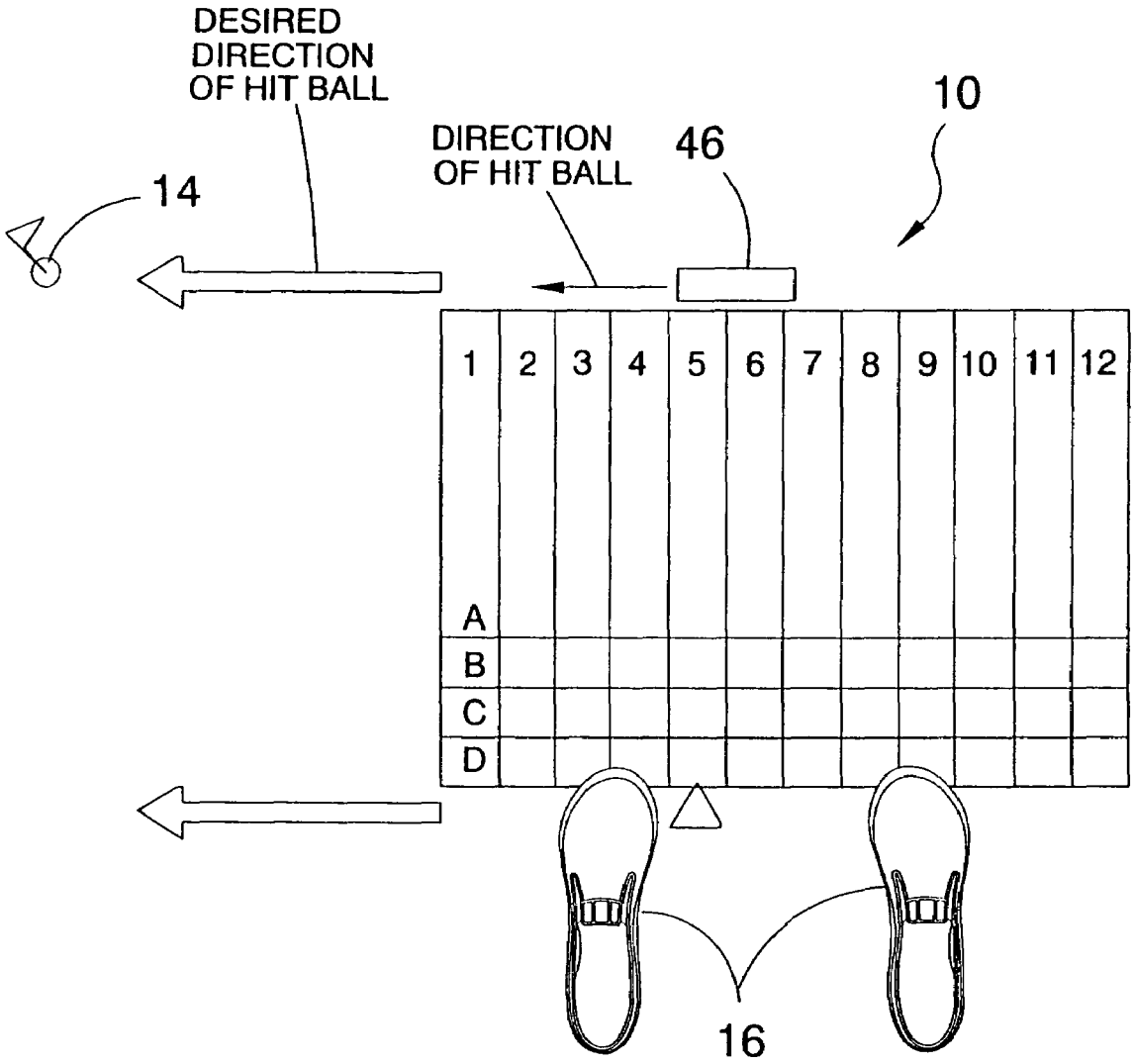
FIG. 13 is a top view demonstrating the third part of function eight of the present invention.

FIG. 13 is a top view of the third part of function eight providing divot analysis. The angle of the resultant divot 46 indicates a swing parallel to the target 14. The purpose of this function is that the golfer 16 can use this information to get the desirable downswing of the club during the hitting of a golf ball 34.

Figure 14:
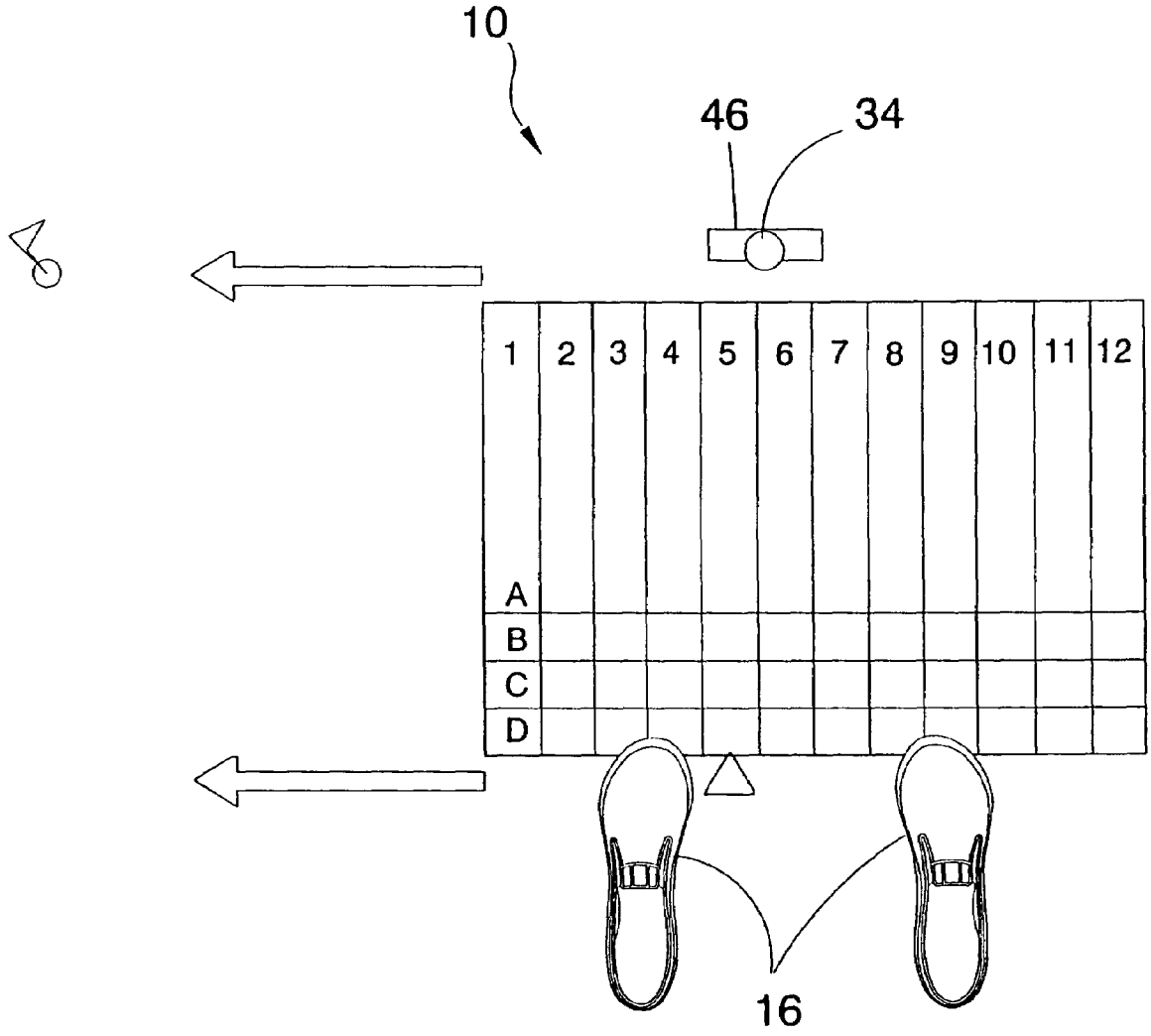
FIG. 14 is a top view demonstrating the first part of function nine of the present invention.

FIG. 14 is a top view of the first part of function nine of the present invention 10 providing divot analysis-ballstriking. Function number nine is a three-part function wherein the divot 46 serves to inform the golfer 16 where they are hitting with regard to the ball 34 position. The resultant divot 46 shown in the first part indicates that the golfer 16 is hitting behind the ball 34. The purpose of this function is that the golfer 16 can use this information to get a desirable strike of the ball 34.

Figure 15:
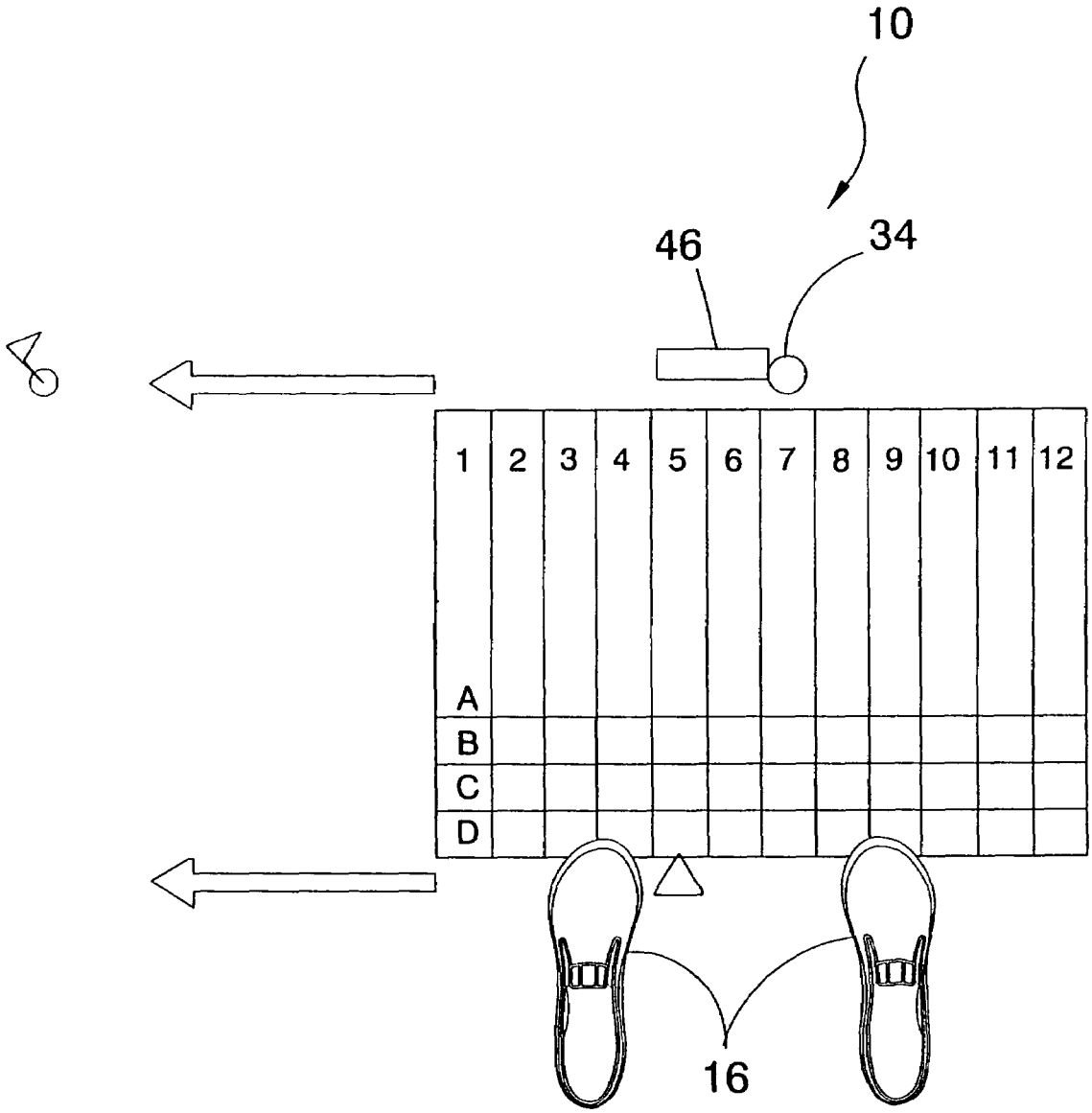
FIG. 15 is a top view demonstrating the second part of function nine of the present invention.

FIG. 15 is a top view of the second part of function nine of the present invention 10 providing divot analysis-ballstriking. The resultant divot 46 shown in the second function indicates that the golfer 16 is hitting slightly in front of the ball 34. The purpose of this function is that the golfer 16 can use this information to get a desirable strike of the ball 34.

Figure 16:
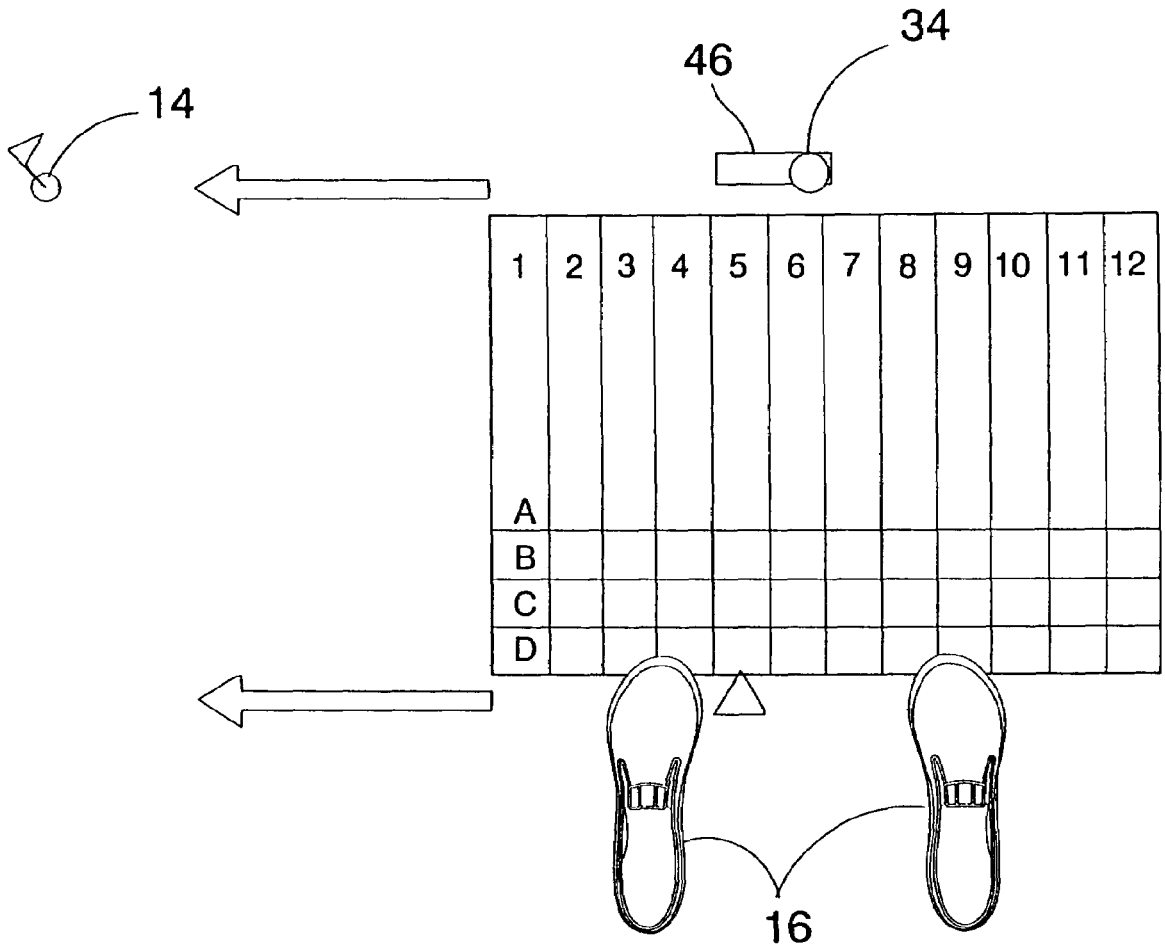
FIG. 16 is a top view demonstrating the third part of function nine of the present invention.

FIG. 16 is a top view of the third part of function nine of the present invention 10 providing divot analysis-ballstriking. The resultant divot 46 shown in the third part indicates that the golfer 16 is hitting the ball 34 good and clean. The purpose of this function is that the golfer 16 can use this information to get a desirable strike of the ball 34.

Figure 17:
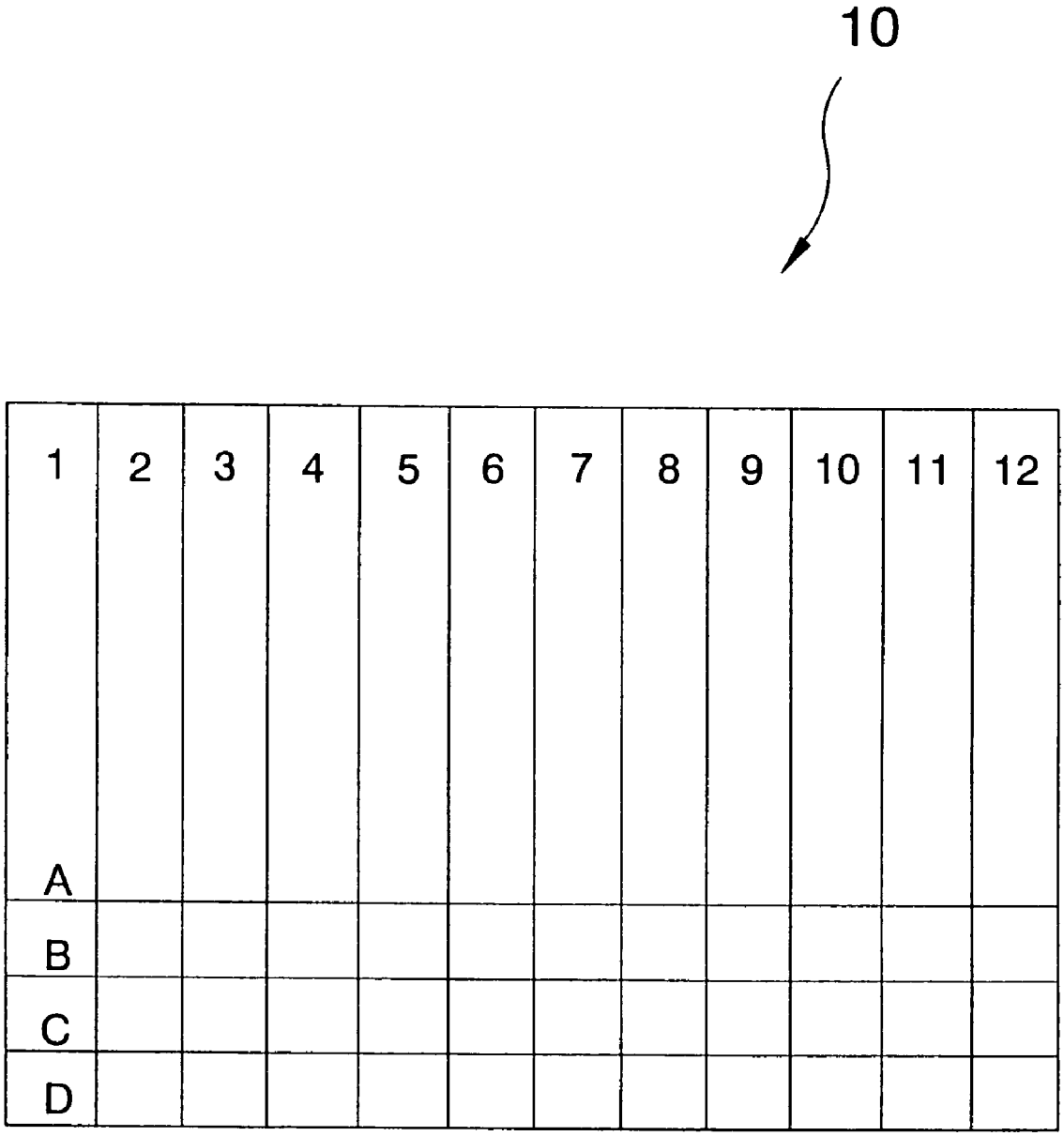
FIG. 17 is a top view demonstrating function ten of the present invention.

FIG. 17 is a top view of the present invention 10. Function ten of the present invention 10 is for use as a standard golf towel during practice and play for the golfer 16 to use to wipe their hands and equipment.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A method of practicing a golf swing comprising the steps of:

a) placing a rectangular cloth towel on a ground surface, aligning a first edge of said towel with a direction of a target, said towel having a first set of indicia made up of spaced, parallel lines perpendicular to said first edge of said towel and a second set of spaced, indicia made up of parallel lines perpendicular to said first set of spaced, parallel lines and parallel to a second edge of said towel opposite directly across from said first edge of said towel;

b) a golfer placing feet directly on the ground surface adjacent said second edge of said towel, wherein the second edge of said towel is folded over as required to obtain proper placement of the legs;

c) placing a golf ball directly on the ground surface adjacent said first edge of said towel, the golfer making a note of the placement of said feet and ball using said indicia;

d) the golfer hitting the ball;

e) the golfer altering the placement of the ball and feet in accordance with how close said ball came to said target when it was hit;

f) repeating the steps of ball and feet placement and hitting the ball until the golfer is able to identify the best location of feet and ball, so that the golfer by placing said towel on the ground surface with said target line lined up with said first edge and tips of the golfer's feet situated at predetermined positions along said body line, and said golfer using said parallel lines as reference points for incrementally making precise adjustments for establishing consistency in golf swing by minimizing random positioning and alignment of said golfer's feet and hands and head of the golf club relative to the position of said ball from one swing to the next.

2. The method of claim 1 in which the golfer examines a divot formed after hitting the ball to provide more information as to how to hit the ball.

3. The method of claim 1 in which said towel when folded is at an angle determined by repeated practice swings.

* * * * *